United States Patent [19]

Farris

[11] Patent Number: 4,846,058

[45] Date of Patent: Jul. 11, 1989

[54] MULTIPLE REGISTERED IMAGE SCREEN PRINTING METHOD AND APPARATUS WITH REMOVABLE PLATENS

[76] Inventor: Jimmy L. Farris, 2394 N. Waterbury, Orange, Calif. 92665

[21] Appl. No.: 946,517

[22] Filed: Dec. 24, 1986

[51] Int. Cl.[4] ..... B41M 1/12; B41L 13/02

[52] U.S. Cl. ..... 101/123; 101/126; 101/DIG. 36

[58] Field of Search ..... 101/126, 123, DIG. 12

[56] References Cited

U.S. PATENT DOCUMENTS

| | | | |
|---|---|---|---|
| 1,562,752 | 11/1925 | Fraser | 101/DIG. 12 |
| 2,348,944 | 5/1944 | White | 101/DIG. 12 |
| 2,680,405 | 6/1954 | Faeber | 101/DIG. 12 |
| 3,161,543 | 12/1964 | Borders | 101/126 |
| 3,634,009 | 1/1972 | Van Dusen | 101/DIG. 12 |
| 4,018,528 | 4/1977 | Demnis | 101/DIG. 12 |
| 4,031,825 | 6/1977 | Jaffa | 101/126 |
| 4,226,181 | 10/1980 | Ericsson | 101/DIG. 12 |
| 4,266,476 | 5/1981 | Maloof | 101/126 |
| 4,516,495 | 5/1985 | Ericsson | 101/DIG. 12 |
| 4,610,200 | 9/1986 | Metso | 101/126 |

*Primary Examiner*—Clyde I. Coughenour
*Attorney, Agent, or Firm*—William L. Chapin

[57] ABSTRACT

A method and apparatus for screen printing a sequence of accurately registered images on a plurality of sheets or objects such as T-shirts use a primary register platen supported by a platen support table. The primary register platen may be moved in a horizontal plane relative to the platen support table, and repositionably secured thereto. Each object to be printed is temporarily fastened to separate secondary register platen, which may be quickly placed in a precisely repeatable overlying relationship to the primary register platen, and quickly removed therefrom. The apparatus includes a transparent register plate which may be quickly placed in an overlaying relationship to an object on a secondary register platen, in a precisely repeatable position relative to said platen support table, and quickly removed therefrom. A screen frame pivotable in vertical plane and fastened to the platen support table is pivoted down into overlying contact with the upper surface of the transparent register plate, and a test image printed on the surface. The screen frame is then tilted away, permitting repositioning and securing the primary register platen to align the image with a desired printing position on the surface of the object affixed to a secondary register platen attached to the primary support platen. The transparent register plate is then removed, permitting the surface of the object to be printed. Since each secondary platen bearing an object is removably installable on the apparatus in a precisely repeatable position, each object may be printed with a precisely registered image.

11 Claims, 5 Drawing Sheets

MULTIPLE REGISTERED IMAGE SCREEN PRINTING METHOD AND APPARATUS WITH REMOVABLE PLATENS

BACKGROUND OF THE INVENTION

1. Field of the Invention

This invention relates to methods and apparatus for screen printing. More particularly, the invention relates to methods and devices which facilitate printing a plurality of different colored, accurately registered images on a quantity of objects such as T-shirts or signs.

2. Description of Background Art

Screen printing is a widely used method of printing multi-colored images onto signs, T-shirts and the like. The process involves first preparing a fine-mesh screen of silk, polyester, or metal by coating it with a photosensitive emulsion, contact printing with a bright light source a photographic image on the emulsion, which thereby hardens the emulsion, and washing away the unexposed emulsion. This preparation process leaves open mesh areas of the screen in the areas where ink is to be permitted to flow through to produce a desired image.

A screen bearing an image produced as described above is placed in intimate contact with the surface of the object to be printed. Ink is then poured over the screen and squeezed through the fine openings in the screen by drawing a squeegee across the surface of the screen, to print the desired image on the surface of the object.

If a single color image is to be printed, the printing process described above is a relatively straight forward operation. Thus, when a single color image is printed on an object, a slight misalignment between the object and the screen printing frame results in a printed image which is slightly misaligned with respect to the perimeter of the object However, a slight misalignment of the printed image is often imperceptible to most people, and therefore is usually acceptable from an appearance standpoint When successive, different colored images are printed onto a surface of an object, the orientation of the object with respect to each screen printing frame used to print each successive color becomes much more critical than for the single color case. This is because improper registration between the various colored images making up a composite, multi-colored image results in an aesthetically unacceptable, blurred, smeared appearance.

To produce accurate registration of successive printed images on a given object, screen printers often use a pair of target markings on the screen. A typical target marking is a small circle having perpendicular cross hairs intersecting at the center of the circle. Targets are contained on each screen, and printed on the object with each color. Before each successive color is printed, targets on the screen are visually aligned with the previously printed targets on the object, before ink is squeezed through the screen to produce the image. This is a time consuming process, and has the additional drawback of requiring target markings on the printed objects.

A Printing Screen Registering Device employing the method of multiple image registration described above is disclosed in U.S. Pat. No. 2,796,831, issued to P. I. Heestand for a device of that title. The Heestand patent discloses a clamp apparatus for registering, via marks on the screen and sheet to be printed, a printing screen on a table or bed plate for repeatedly printing a pattern in exactly the same registered position on successive sheets of paper or the like.

A screen printing machine using a transparent sheet to check registration of a successive image with a previously printed image is disclosed in German Pat. No. 2,816,573, issued Nov. 2, 1978 to Svecio Silkscreen. The machine disclosed includes an adjustable printing table by which an image on an attached sheet may be brought into registration with an image printed on a transparent sheet. Each time a new sheet to be printed is mounted to the printing table, the registration adjustment process must be repeated.

The present invention was conceived of to overcome certain limitations of existing methods and apparatus for screen printing accurate registered multiple images.

OBJECTS OF THE INVENTION

An object of the present invention is to provide a method and apparatus for efficiently screen printing a plurality of accurately registered images on a surface of an object.

Another object of the invention is to provide a method and apparatus by which a plurality of accurately registered images may be screen printed on the surface of an object without requiring target indicia to be printed on the object.

Another object of the invention is to provide a method and apparatus for screen printing a plurality of accurately registered images on a garment such as a T-shirt.

Another object of the invention is to provide a method and apparatus for screen printing a plurality of accurately registered images on a group of objects requiring only one adjustment procedure for each of the images.

Another object of the invention is to provide an apparatus for efficiently screen printing multiple, accurately registered images on a quantity of objects, which apparatus is portable and easily attached to and removed from a table top.

Various other objects and advantages of the present invention, and its most novel features, will be particularly pointed out hereinafter in connection with the appended claims.

It is to be understood that although the invention disclosed herein is fully capable of achieving the objects and providing the advantages mentioned, the structural and operational characteristics of the invention described herein are merely illustrative of the preferred embodiments. Accordingly, I do not intend that the scope of my exclusive rights and privileges in the invention be limited to the details of construction and operation described. I do intend that reasonable equivalents, adaptations and modifications of the various embodiments and alternate forms of the present invention which are described herein be included within the scope of the invention as defined by the appended claims.

SUMMARY OF THE INVENTION

Briefly stated, the present invention comprehends a screen printing apparatus for printing a sequence of different colored images in accurate registration with one another, on a plurality of objects such as T-shirts or paper sheets.

The apparatus according to the present invention includes a primary register platen lying on a horizontal platen support table and adjustable in a horizontal plane with respect to the platen support table. A pair of clamps engageable with a screen frame is pivotably mounted to a base extension of the platen support table, and is pivotable in a vertical plane.

Each object to be printed is affixed to a separate one of a plurality of identical removable secondary platens which may be quickly and conveniently placed on the primary register platen in a repeatable, accurately registered position relative to the primary register platen by means of upwardly protruding stud pins on the primary platen engageable with slots and holes on the secondary platens.

The apparatus includes a transparent register plate which may be quickly and conveniently placed over the secondary platen. Repeatable, accurately registered placement of the transparent register plate relative to the base of the apparatus is achieved by means of a second set of upwardly protruding studs attached to the base and engageable with holes near one edge of the transparent register plate.

To use the apparatus, the transparent register plate is placed temporarily over the first secondary platen bearing an object to be printed with an image of a particular color. The transparent register plate is printed with that image, and the primary register platen and attached secondary platen moved relative to the base and transparent register plate until the image on the transparent register plate lies over the desired printing area on the object affixed to the secondary register platen.

The transparent register plate is then removed, and the image printed on the object. The first secondary register platen and affixed article bearing the freshly printed image is then removed, and the second of the plurality of secondary platens bearing the second object to be printed is placed in position on the primary platen. Since each of the secondary platens is precisely positioned with respect to the screen printing frame when it is placed on the stud pins projecting from the primary platen, the object on each secondary platen may be printed with a precisely registered image without any additional alignment procedures. Thus, the novel screen printing apparatus according to the present invention permits printing as many objects as desired with an accurately registered image, while only requiring an adjustment of the primary platen for the first object to be printed with a given image.

DETAILED DESCRIPTION OF THE INVENTION

Figures 1, 1A, 5:
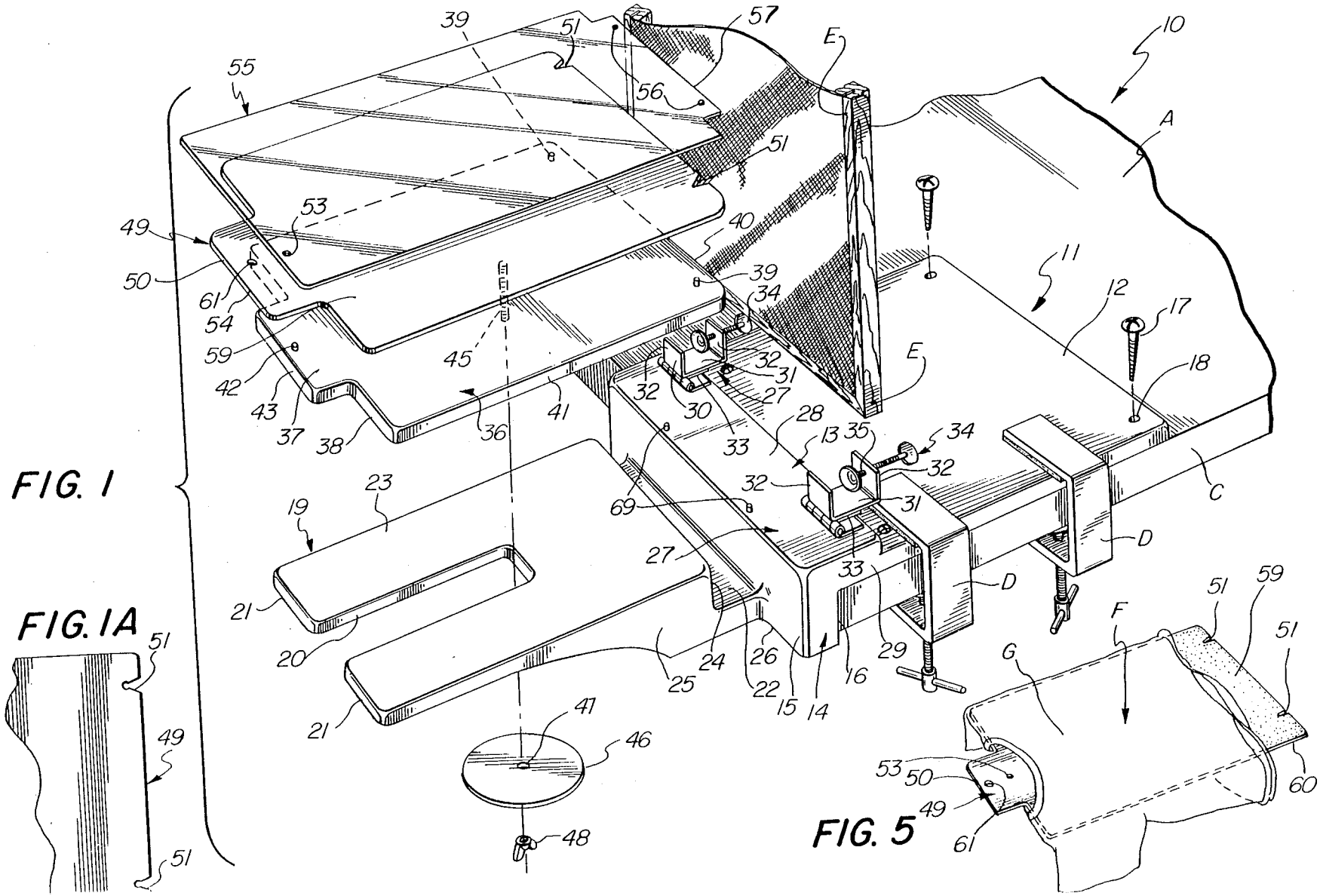
FIG. 1 is an exploded upper perspective view of the multiple platen screen printing apparatus according to the present invention.
FIG. 1A is a fragmentary, enlarged upper plan view of a secondary register platen forming part of the apparatus of FIG. 1.
FIG. 5 is a fragmentary perspective view of the apparatus of FIG. 5 showing a secondary register platen with a T-shirt to be printed affixed to the platen.

Referring now to FIG. 1, a portable multiple platen screen printing apparatus 10 according to the present invention is shown mounted to a table top A. Apparatus 10 includes a base unit 11 having a thin, generally uniform thickness, rectangular, plan-view base 12. A flat, rectangular plan-view raised rib section 13 extends laterally across one end of the base, and a rectangular flange section 14 having a generally rectangular shape in elevation view, projects perpendicularly downwards from the base 12.

The front face 15 of flange section 14 is flush with the front lateral edge of rib section 13, and the thickness of the flange section is approximately equal to the combined vertical thickness of the base and overlying rib section. The rear surface 16 of flange section 14 is flat and vertical, and adapted to fit against the front vertical face of a table top A.

If it is desired to fasten apparatus 10 temporarily to a table top A, a lateral face of base 12 of the apparatus is positioned sufficiently close to a lateral face C of table top A to permit the jaws of C-clamps D to be slid over the upper surface of the base and the lower surface of the tale top and tightened, thereby securing base unit 11 to the table top. For more permanent installations, screws 17 passing through holes 18 in base 12 may be tightened to table top A.

As shown in FIG. 1, base unit 11 of apparatus 10 includes a cantilevered platen support table 19 extending perpendicularly outwards from the front face 15 of flange section 14. Platen support table 19 has a generally rectangular cross-sectional shape in plan-view, with a deep, rectangular slot 20 extending perpendicularly back from the front face 21 of the printing table, symmetrically disposed along the longitudinal center line of the printing table.

Figure 3:
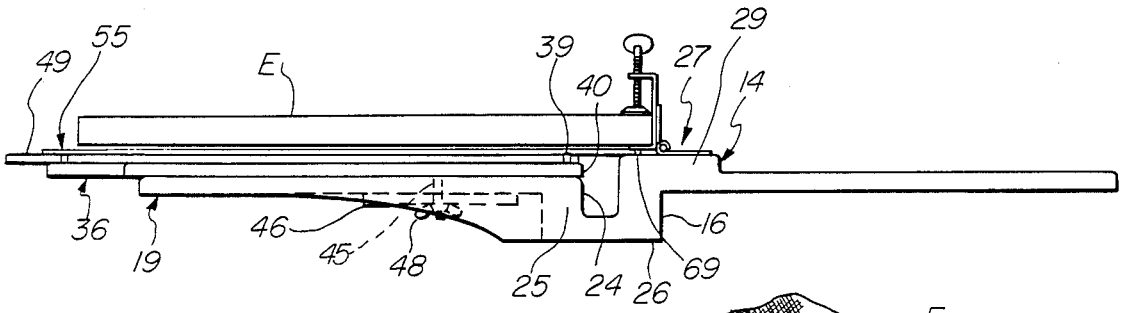
FIG. 3 is a side elevation view of the apparatus.
Figure 4:
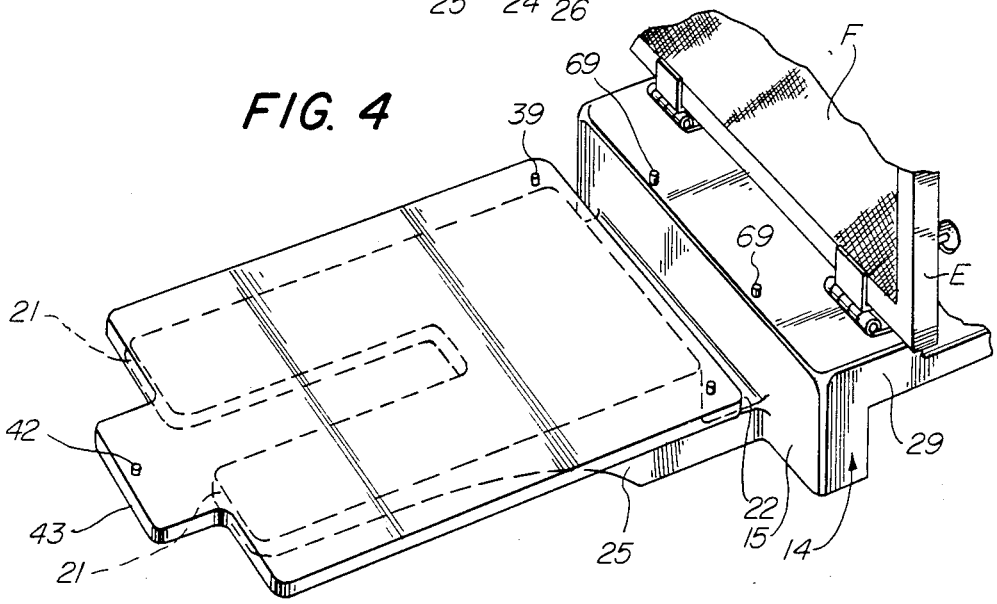
FIG. 4 is a fragmentary upper perspective view of the apparatus with a transparent register plate and a secondary register platen forming part of the apparatus removed.

As may be seen best by referring to FIGS. 1 and 3, a deep groove 22 extends downward from the flat upper surface 23 of the platen support table 19 and extends across the full width of the printing table, forming a U-shaped channel between the front face 15 of flange section 14 of base 12, and rear face 24 of the platen support table 19.

Base unit 11 may be made of any suitably strong and rigid material such as molded fiberglass. As may be seen best in FIGS. 1 and 3, side walls 25 projecting perpendicularly downwards from the outer lateral edges of the platen support table 19 may be molded integrally with base unit 11 to form a downwardly concave lower face in the platen support table. As shown in FIGS. 1 and 3, the side walls 25 of the platen support table 19 extend perpendicularly forward from the front vertical face 15 of flange section 14, in flush alignment with the lower face 26 of the flange section. Preferably, each side wall 25 of the platen support table 19 tapers upwards in an arcuate curve to have at the front faces of the side walls the same vertical thickness as the front surface 21 of the table.

As may be seen best by referring to FIG. 1, two leaf hinges 27 are mounted on the upper face 28 of rib section 13. Leaf hinges 27 are positioned at laterally displaced ends of rib section 13, with the outer lateral edge of each spring being spaced an equivalent, short distance from the side faces 29 of the rib section. The pivot axes of both hinges 27 are colinear with a horizontal line joining the two hinges.

As shown in FIG. 1, a C-clamp 30 having a rectangular base 31 and upright legs 32 is fastened to the upper leaf 33 of leaf hinge 27, with the rectangular base of the C-clamp in flat contact with the upper leaf of the hinge. A thumbscrew 34 mounted in a threaded hole 35 passing through an upright leg 32 of C-clamp 30 is used to clamp the edge of a standard screen printing frame E between the upright legs of each C-clamp. Thus clamped, screen printing frame E may be pivoted in a vertical plane downwards towards the upper surface of the platen support table 19 into a horizontal printing position, as shown in FIG. 3, or upwards to a vertical, non-printing position, as shown in FIG. 1.

As may be seen best by referring to FIG. 1, the apparatus 10 according to the present invention includes a flat, uniform thickness primary register platen 36 having a generally rectangular plan-view cross-section. Primary register platen 36 includes a rectangular flange or neck 37 extending forward from the front face of the primary register platen, symmetrically disposed about its longitudinal center line.

As shown in FIGS. 1 and 3, two circular cross-section dowel pins or studs 39 protrude perpendicularly upwards from the upper surface of the primary register platen, near its rear face 40. Studs 39 are disposed on a lateral line slightly forward from the rear face 40 of the primary register platen 36, and are located inwards at small equal distances from the side faces 41 of the primary register platen. A third stud 42 similar to studs 39 protrudes perpendicularly upwards from the upper face of neck 37 of the primary register platen 36, positioned on its longitudinal center line a slight distance inwards from the front face 43 of the neck.

Figure 2:
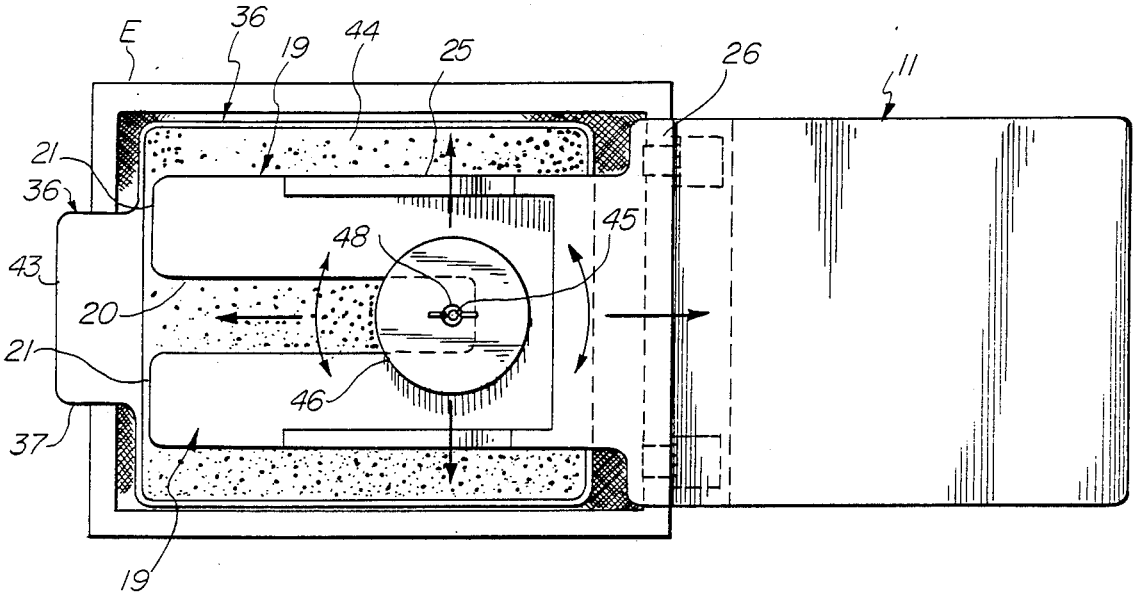
FIG. 2 is a lower plan view of the apparatus of FIG. 1.

As may be seen best by referring to FIG. 2, the underside of primary register platen 36, which is preferably fabricated from molded fiberglass, is hollow, and filled with a material having a relatively high coefficient of friction, such as a medium-hard rubber, to provide a non-slip lower surface 44. As shown in FIGS. 2 and 3, a threaded stud 45 protrudes perpendicularly downward from the lower surface 44 of the primary register platen 36. The threaded stud 45 is positioned along the longitudinal center line of primary register platen 36, and slightly rearward of the lateral centerline.

The apparatus 10 includes a flat, circular disc 46 having a central hole 47 through its thickness dimension adapted to insertably receive the lower end of the threaded stud 45. As shown in FIGS. 1 through 3, the primary register platen 36 may be clamped with its non-slip lower surface 44 in flush contact with the upper surface 23 of the platen support table 19. This is accomplished by positioning threaded stud 45 within the rectangular slot 20 in the printing table 19, inserting circular disc 46 upwards over that portion of the threaded stud protruding below the lower surface of the printing table, and tightening a wing nut 48 threaded onto the stud tightly upwards against the lower surface of the circular disc. As shown in FIG. 2, this means of clamping the primary register platen 36 to the platen support table 19 permits translating and/or rotating the primary register platen to any desired parallel orientation with respect to the platen support table.

As shown in FIG. 1, apparatus 10 includes a secondary register platen 49. Secondary register platen 49 is preferably fabricated from a thin, uniform thickness sheet of a rigid, heat-resistant material such as fiberglass. Secondary register platen 49 has a plan-view cross-sectional shape substantially similar to that of primary register platen 36. Thus, secondary register platen 49 also includes a rectangular flange or neck 50 extending forward from its front face, symmetrically disposed about the longitudinal center line of the secondary register platen.

As may be seen best by referring to FIGS. 1 and 1A, the secondary register platen 49 has two notches 51 cut forward from its rear face 52. The notches 51 have arcuate inner faces, and are coaxially aligned with the upwardly protruding studs 39 of the primary register platen 36, when the secondary register platen 49 is in congruent, parallel alignment with the primary register platen.

The secondary register platen 49 also includes a hole 53 through its thickness dimension near the front face 54 of the secondary register platen. The hole 53 is coaxially aligned with the upward protruding stud 42 of the primary register platen 36, when the secondary register platen is in congruent, parallel alignment with the primary register platen. With a secondary register platen 49 thus aligned with and overlying the primary register platen 36, the notches 51 of the secondary register platen may be engaged with the studs 39 of the primary register platen, and the neck 50 of the secondary register platen pivoted downwards into parallel alignment with the neck 37 of the primary register platen until the stud 42 near the front face of the neck of primary register platen engages the hole 53 near the front face of the neck of the secondary register platen. In this way, a secondary register platen 49 may repeatedly be removed from and replaced on the upper surface of the primary register platen 36, in precise, repeatable alignment therewith.

As shown in FIG. 1, the screen printing apparatus 10 according to the present invention includes a transparent register plate 55. The transparent register plate 55 is preferably fabricated form a thin, uniform thickness sheet of clear, durable plastic such as polycarbonate or acrylic. The transparent register plate has in plan-view a rectangular cross-sectional shape similar to that of the primary register platen 36 and secondary register platen 49, but without a flange or neck.

As may be seen best by referring to FIG. 1, the transparent register plate 55 has two circular holes 56 through its thickness dimension. The holes 56 are centered on a lateral line slightly forward of the rear lateral face 57 of the transparent register plate 55 and are spaced at small, equal distances inwards of the longitudinal faces of the register plate. The location of holes 57 in the transparent register plate 55 places them in respective coaxial alignment with two studs 69 protruding upwards from the upper surface 28 of the rib section 13 of the base 12 of the apparatus, when the transparent register plate is in congruent, parallel alignment with the primary register platen. The studs 69 are disposed on a lateral line slightly rearward from the front face 15 of the rib section 13 of base 12.

The height of studs 39 on the primary register platen 36 is sufficient to protrude upwards through the V-shaped notches 51 in the rear edge of a secondary register platen 49 in place in the primary register platen. The height of studs 69 on rib section 13 is sufficient to protrude out through the holes 56 in the transparent register plate 55 in place over a secondary register platen. Preferably, holes 56 are provided with grommets or eyelets 58 to prevent excessive wear of the sidewalls of the holes. Such wear could occur since the transparent register plate is repeatedly placed on and removed from an overlying alignment with a secondary register platen 49 during the operation of the apparatus, as will be described below, and the holes 56 are engaged by the studs 69 on the rib section 13 each time the transparent register plate is placed on the apparatus.

OPERATION OF THE INVENTION

The operation of the screen printing apparatus according to the present invention may be best understood by referring to FIGS. 5 through 13 in conjunction with the following explanation.

As shown in FIG. 5, an object to be printed with th apparatus 10, as for example a T-shirt F or other garment, is first attached to a secondary register platen 49. The surface G of the object F to be printed is immobilized with respect to the upper surface 59 of the secondary register platen, preferably by coating the surface 59 with a removable textile table adhesive, and pressing the surface G into flat contact with the surface 59.

Figure 6:
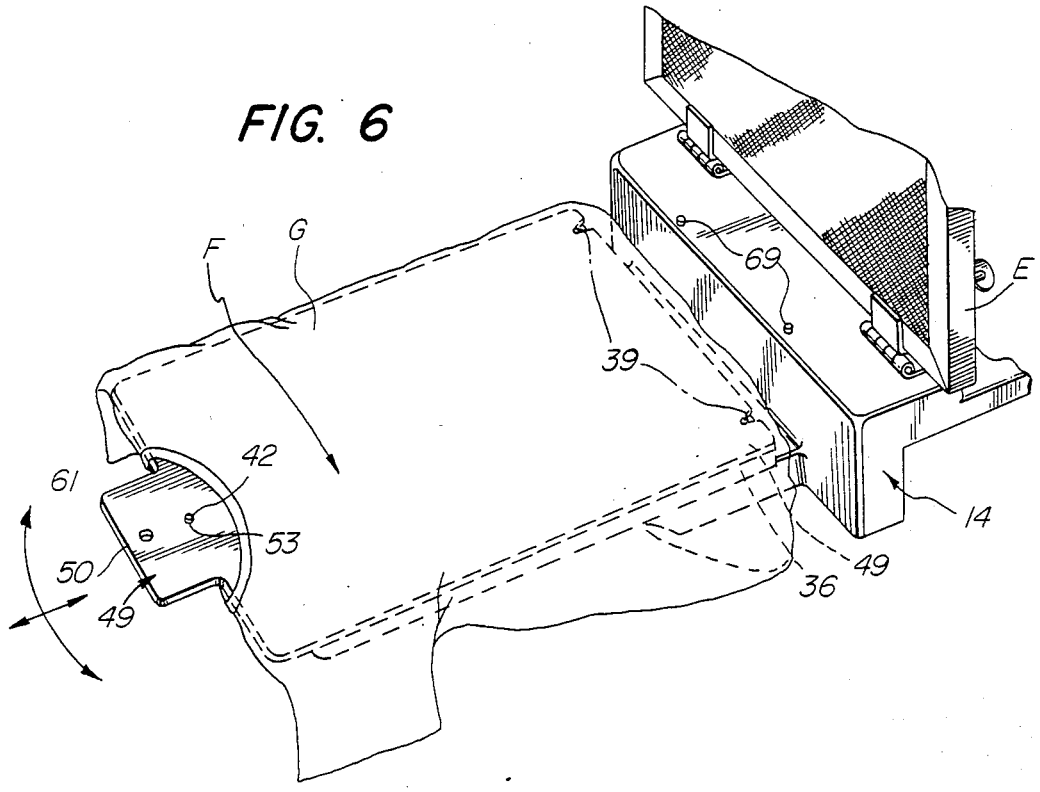
FIG. 6 is a fragmentary upper perspective view of the apparatus showing a secondary register platen with a T-shirt to be printed affixed to the platen mounted on the primary register platen.

As shown in FIG. 5, the lower portion of the T-shirt F hangs free of the lower surface 60 of a secondary register platen 49. As shown in FIG. 6, this permits a secondary register platen 49 with attached T-shirt F to be slid forward over the primary register platen 36 until the notches 51 in the rear face 52 of the secondary register platen engage the studs 39 of the primary register platen, whereupon the neck 50 of the secondary register platen may be pivoted downwards until the hole 53 through the neck engages the stud 42 of the primary register platen. With the respective slots and studs and hole and stud engaged, the secondary register platen 49 is rigidly and repeatably secured against horizontal motion with respect to the primary register platen 36. The groove 22 in the flat, upper surface 23 of the printing table 19 accommodates the upper waist portion of the T-shirt F.

Figure 7:
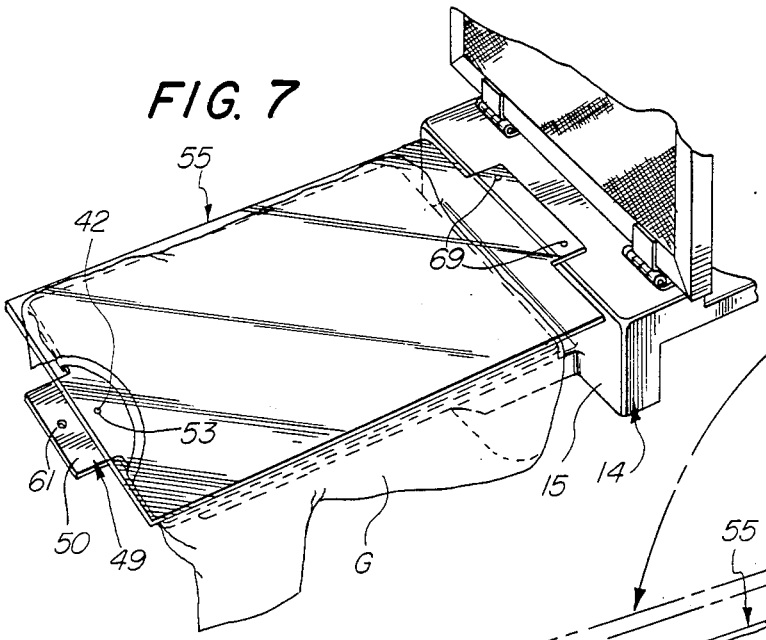
FIG. 7 is a fragmentary upper perspective view of the apparatus of FIG. 5 with the transparent register plate in place over the T-shirt.

With a secondary register platen 49 and attached T-shirt F secured to the apparatus 10 as described above, the transparent register plate 55 is placed down on the upper surface G of the T-shirt, as shown in FIG. 7, with the holes 56 of the transparent register plate engaging the studs 69 on the rib section 13. In this way, the transparent register plate 55 is rigidly and repeatably secured against horizontal motion with respect to the base unit 11 of the apparatus.

Figure 8:
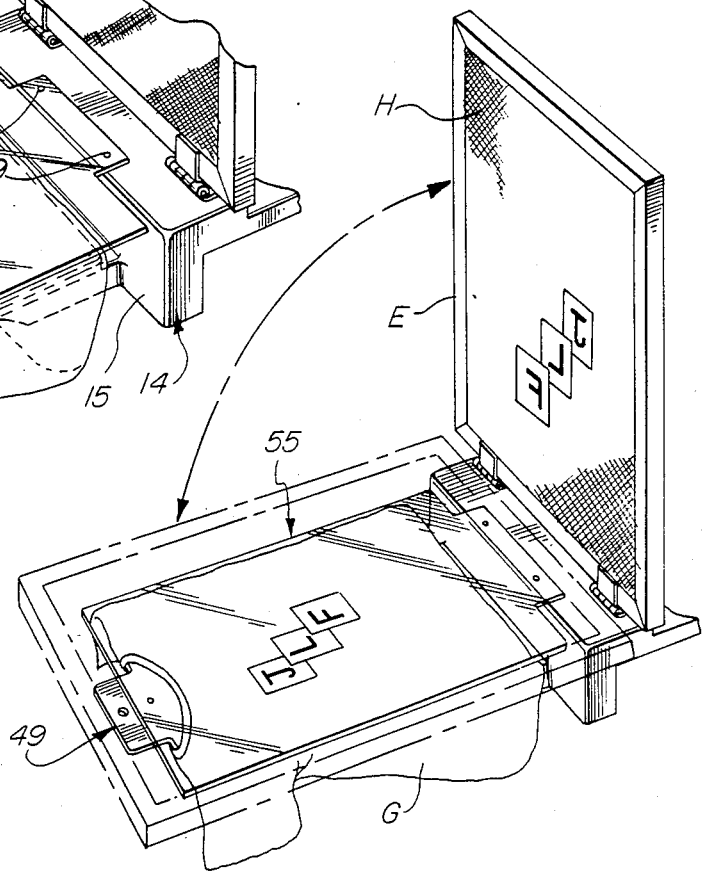
FIG. 8 is a fragmentary upper perspective view of the apparatus of FIG. 7 showing how the first, black, key-line image is printed onto the upper surface of the transparent register plate.

With the transparent register plate 55 in place over the surface G of the T-shirt F to be printed, a screen printing frame E is pivoted down into flush contact with the transparent register plate, as shown in FIG. 8. As shown in FIG. 8, screen H in screen printing frame E has a mesh opening defining the first image to be printed onto the T-shirt F.

In the present example, the first image to be printed comprises the key-line outline, to be printed in black, of three intersecting rectangles containing the letters "J", "L" and "F", respectively.

Figure 9:
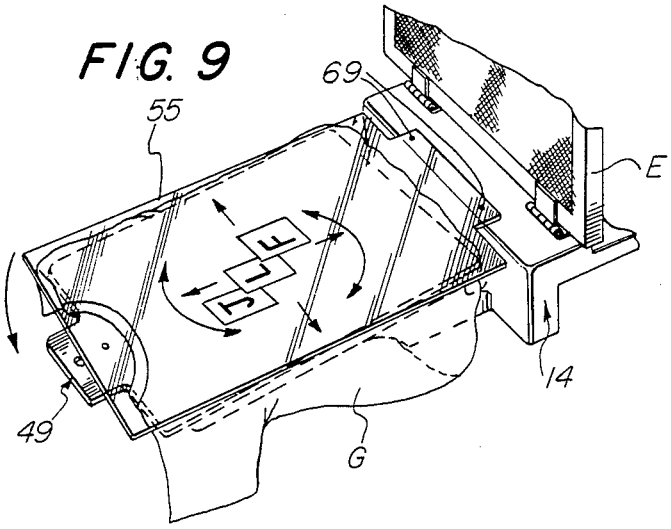
FIG. 9 is a fragmentary upper perspective view of the apparatus of FIG. 8 showing the primary register platen and attached secondary register platen bearing the T-shirt being re-positioned so that the black, key-line image on the transparent register plate overlies the desired printing area on the T-shirt.

With screen printing frame E in a horizontal printing position, black ink is forced through the mesh openings in screen H onto the transparent register plate 55, thereby printing a black image onto the transparent register plate. Next, screen frame E is tilted away from the transparent register plate 55, into a vertical position. This position permits the image printed onto the transparent register plate to be viewed in relation to the surface G of the T-shirt F. The wing nut 48 may then be loosened from the threaded stud 45 of the primary register plate 36 protruding downwards through the slot 20 of the platen support table 19. This permits, as shown in FIG. 9, movement in a horizontal plane of the primary register platen 36, along with attached secondary register platen 49 and T-shirt F, until the image printed on the transparent register plate 55 overlies a desired printing area G on the T-shirt. At this point, wing nut 48 is re-tightened on the threaded stud 45, securing the surface G to be printed in the desired printing position. The transparent register plate 55 may then be removed, and the black key-line image printed on it removed with solvent.

Figure 10:
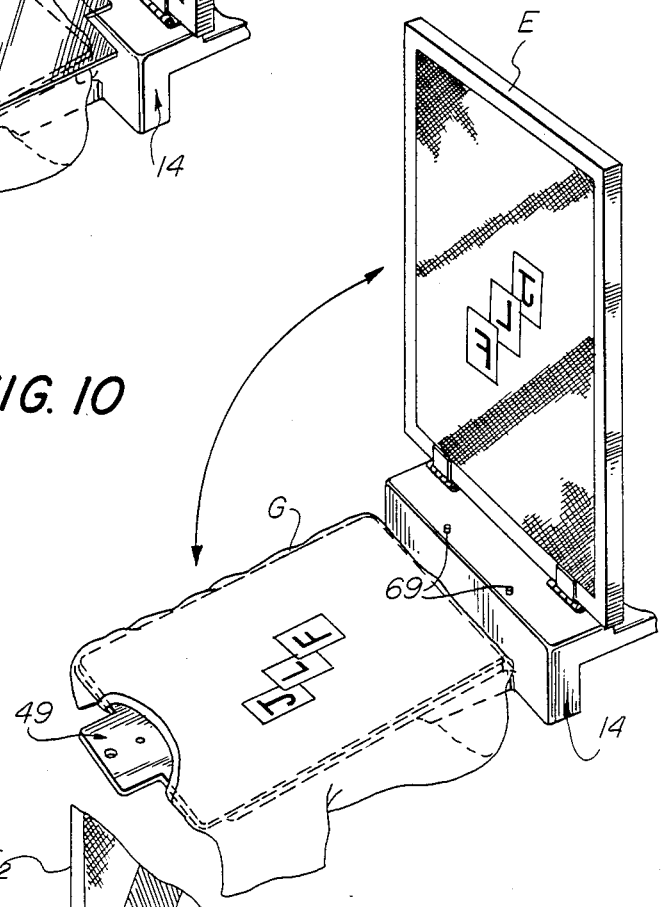
FIG. 10 is a fragmentary upper perspective view of the apparatus of FIG. 9 with the transparent register plate removed, and showing how the black, key-line image is printed onto the T-shirt.

The sequence of steps described above positions the T-shirt F on apparatus 10 so that the first, key-line image on screen H to be printed onto the T-shirt falls precisely in the desired position on the surface G of the T-shirt. Thus positioned, a black key-line image may be printed on the T-shirt F, as shown in FIG. 10.

With the screen frame E pivoted to a vertical position after having printed a first, key-line image on a first T-shirt F attached to a first secondary register platen, that secondary register platen and attached T-shirt may be removed to allow the ink image on the surface G of the T-shirt to dry. A hole 61 through the thickness dimension of the secondary register platen 49 and near its front face 54 is provided to facilitate hanging the secondary register platen while the freshly inked T-shirt attached to it is allowed to dry. This permits a second secondary register platen 49 and attached T-shirt F to be installed on the apparatus 10 exactly as described above. For the reasons set forth above, the surface G of this second T-shirt F will also be precisely oriented with respect to the key-line image on the screen H. Thus, this second, and as many succeeding T-shirts F as desired, each attached to separate secondary register platen, may be printed with a precisely registered key-line image, without requiring any further adjustments of apparatus 10.

After the last T-shirt F in a lot has been printed with the first, black key-line image, screen frame E is removed from the apparatus 10 and a new screen frame E2 installed. Screen frame E2 has a screen H2 bearing an image to be printed in a different color on the lot of T-shirts F. In the example illustrated in FIG. 11, screen H2 in screen frame E2 has a mesh opening defining a blue colored rectangle of the appropriate size and position to fit within the black key-line rectangle containing the letter "F" and previously printed onto each of the T-shirts.

Figure 11:
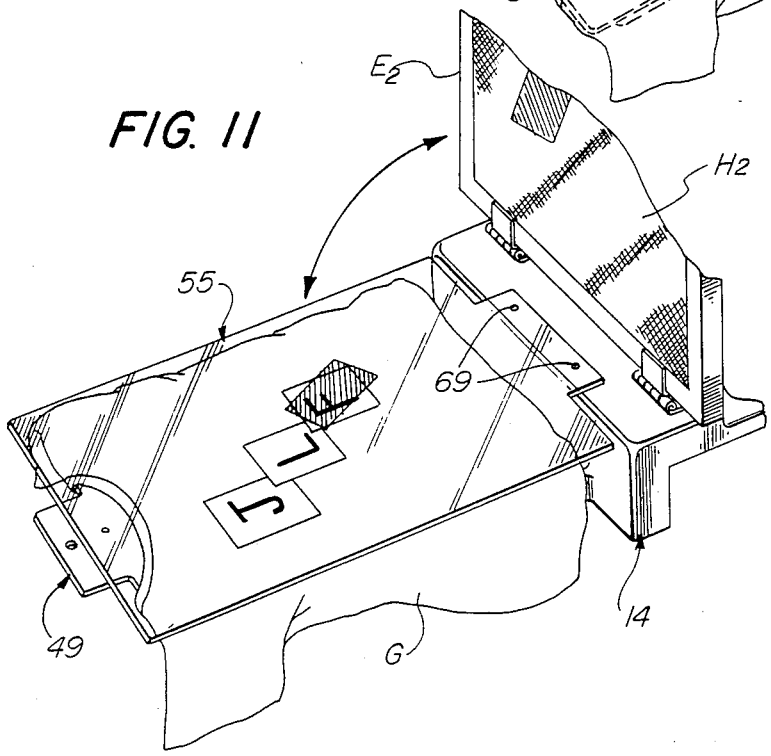
FIG. 11 is a fragmentary upper perspective view of the apparatus of FIG. 9 showing how a first image of a particular color is printed onto the upper surface of the transparent register plate.
Figure 12:
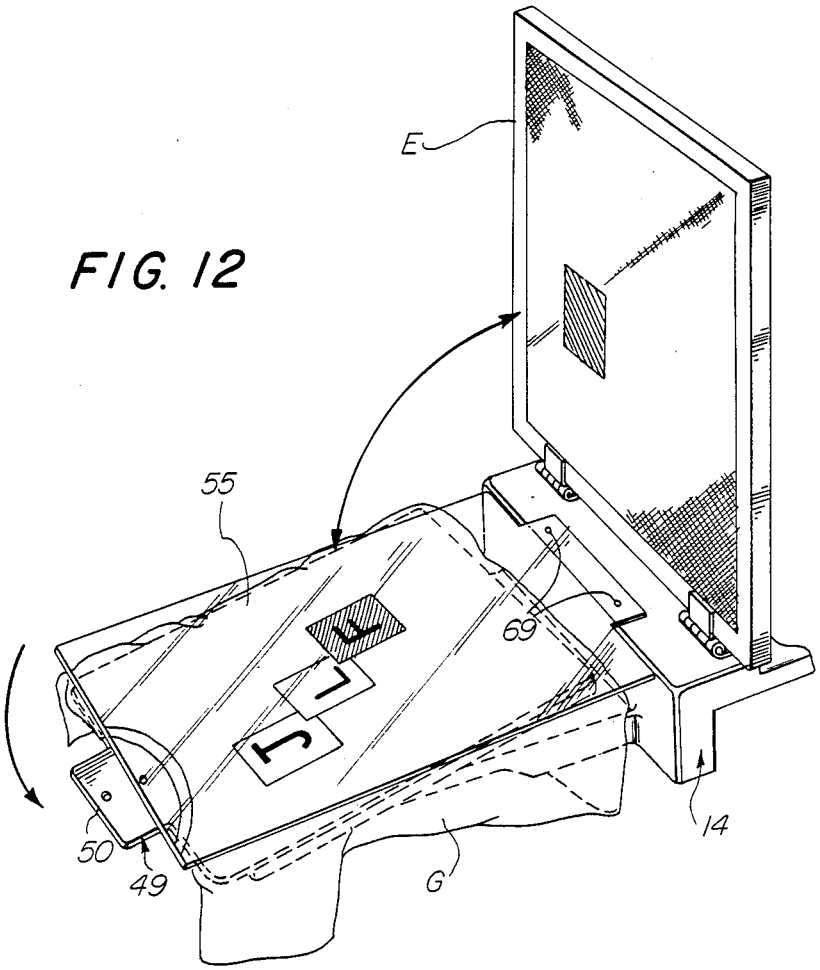
FIG. 12 is a fragmentary upper perspective view of the apparatus of FIG. 9 showing the primary register platen and attached secondary register platen being re-positioned so that first image on the transparent register plate is in proper registration with the previously printed, black, key-line image on the T-shirt.

As shown in FIG. 11, a secondary register platen 49, bearing a still-attached T-shirt F previously printed with a black key-line image which has been allowed to dry, is installed on the apparatus 10 exactly as has been described above. The transparent register plate 55, which has been previously swabbed free of any image as described above, is then installed on apparatus 10 over T-shirt F, exactly as has been previously described The transparent register plate 55 is then printed with a blue rectangle, as shown in FIG. 11. As shown in FIG. 11, the blue rectangle printed on the transparent register plate 55 is initially mis-aligned with the black key-line rectangle containing the letter "F" and previously printed on the T-shirt F. Thus, as shown in FIG. 12, the wing nut 48 may once again be loosened, and the primary register platen 36 adjusted to bring the previously printed image on the T-shirt F into proper registration with the blue image on the transparent register plate 55. The wing nut 48 may then be re-tightened, and the transparent register plate 55 removed from the apparatus, and cleaned with solvent. The first T-shirt F and as many previously printed T-shirts as desired may then be printed with precisely registered blue images, without requiring any further adjustments of the apparatus 10.

Figure 13:
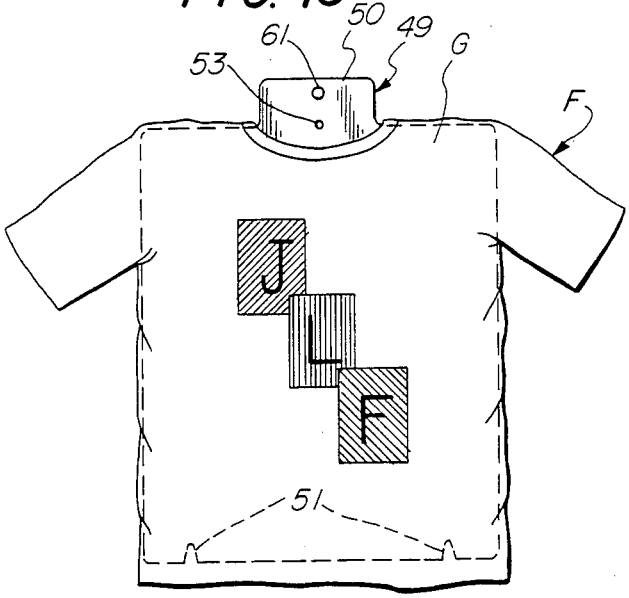
FIG. 13 shows a finished T-shirt on which each of three different colored images has been printed on the T-shirt in proper registration with respect to the black, key-line image first printed on the T-shirt.

In an exactly analogous fashion, as many different color images as desired may be printed onto any size lot of T-shirts, as shown in FIG. 13. Thus, the apparatus 10 according to the present invention permits screen printing any number of successive, precisely registered, different colored images on any size lot of T-shirts or other objects, while requiring only a single adjustment for each different colored image to be printed.

What is claimed is:

1. An apparatus for printing a sequence of multiple images each accurately registered with one another on each object of a plurality of any number of objects comprising:

(a) a stationary platen support table having a generally smooth upper surface, (b) a single primary register platen having a generally smooth upper surface, (c) means for repositionably fastening said primary register platen to said platen support table in overlying relationship thereto, said fastening means holding said upper surface of said primary register platen parallel to the underlying surface of said platen support table, while permitting adjustment by translational and rotational movement of said primary register platen relative to said platen support table, and said fastening means being capable of being tightened to hold said primary register platen in a desired position, relative to said platen support table, (d) a separate secondary register platen means having a generally smooth upper surface for each object, (e) means for holding said secondary register platen means in overlying relationship to said primary register platen, stationary to respect to said primary register platen, said holding means permitting repeated removal and replacement of a said secondary register platen means in a repeatable overlying relationship to said primary register platen, (f) a transparent register plate made of transparent material having generally flat and parallel upper and lower surfaces, and (g) means for holding said transparent register plate in overlying relationship to said secondary register platen means stationary with respect to said platen support table, said holding means permitting repeated removal and replacement of said transparent register plate in a repeatable overlying relationship relative to said platen support table, whereby any arbitrary number of said objects may each be printed with a sequence of accurately registered different color images while requiring adjustment of said apparatus only once for each color.

2. The apparatus of claim 1 further comprising means for pivotably supporting a screen printing frame near an edge of said platen support table, said means permitting pivoting in a vertical plane a screen in said screen printing frame into parallel, overlying contact with the upper surface of said secondary register platen.

3. The apparatus of claim 2 further comprising means for fastening said platen support table to a supporting structure.

4. The apparatus of claim 1 wherein said means for holding said secondary register platen in fixed overlying relationship with respect to said primary register platen comprises in combination a plurality of dowel pins protruding perpendicularly upwards from the upper surface of said primary register platen, and apertures in the bottom surface of said secondary register platen registered with and insertably engageable by said dowel pins.

5. The apparatus of claim 4 wherein said apertures in said secondary register platen comprise at least two apertures near a rear edge of said secondary register platen communicating with the rear edge by means of slots, and at least one aperture near a front edge of said secondary register platen having a diameter very slightly larger than the outer diameter of a registered dowel pin on said primary register platen, whereby said primary register platen may be placed on and held in overlying relationship to said primary register platen by placing said secondary register platen in oblique relationship to said primary register platen, engaging said slots with registered dowel pins on said primary register platen, sliding said secondary register platen rearward until said registered dowel pins bottom in said slots, and pivoting the front edge of said secondary register platen downwards until said aperture near said front edge of said secondary register platen is insertably engaged by the registered primary register platen dowel pin located near its front edge.

6. The apparatus of claim 1 wherein said means for holding said transparent register platen in overlying relationship with respect to said secondary register platen and fixed with respect to said platen support table comprises in combination a plurality of dowel pins protruding perpendicularly upwards from an upper surface of an extension of said platen support table, and apertures on the bottom surface of said transparent register platen registered with and insertably engageable by said dowel pins.

7. The apparatus of claim 6 wherein said upper surface of said extension of said platen support table from which said dowel pins for engaging said transparent register plate protrude is rearward of the rear edges of said primary and secondary register platens.

8. The apparatus of claim 7 further comprising a laterally disposed channel between the front upper surface of said platen support table and the rearward surface of said platen support table, said channel being adapted to receive a portion of a garment which may be attached to said secondary register platen for printing.

9. The apparatus of claim 8 wherein said means for repositionably fastening said primary register platen in overlying relationship to said platen support table comprises in combination a rectangular aperture through said platen support table, a threaded stud protruding downwards from said primary register platen through said slot, and a wing nut and washer threaded onto said stud.

10. An apparatus for printing a sequence of multiple images each accurately registered with one another on each object of a plurality of any number of objects comprising:

(a) a stationary platen support table having a generally smooth upper surface, (b) a base unit extending rearward from a rear edge of said platen support table, said base unit being adapted to fasten to a support structure, (c) a single primary register platen having generally smooth and parallel upper and lower surfaces for fastening to said platen support table, (d) means for adjustably and repositionably fastening said primary register platen to said platen support table in parallel overlying relationship thereto, (e) a separate secondary register platen for each object, said secondary register platen having generally smooth and parallel upper and lower surfaces, and said secondary register platen being removably fastenable in fixed, overlying relationship to said primary register platen by means of apertures through said secondary register platen engageable by registered dowel pins protruding upwards from the upper surface of said primary register platen, and (f) a transparent register plate having smooth and parallel upper and lower surfaces, said transparent register plate being removably fastenable in fixed, overlying relationship to said base unit of said platen support table by means of apertures near a rear edge of said transparent register plate engageable by dowel pins protruding upwards from the upper surface of said base unit, whereby any arbitrary number of said objects may each be printed with a sequence of accurately registered different color images while requiring adjustment of said apparatus only once for each color.

11. A method for printing a sequence of multiple images each accurately registered with one another on each object of a plurality of objects comprising:

(a) affixing each of said objects to a separate secondary register platen, (b) removably fastening in a precisely registered position one of said secondary register platens bearing a said object to a single primary register platen repositionably fastened in a desired adjustable position to a stationary platen support table, (c) removably fastening in a precisely registered position a transparent register plate in overlying parallel relationship to said object to be printed, (d) printing alternatively by means of a transfer device repeatably pivotable to a precise position relative to said transparent register to plate an image on the upper surface of said register plate and said object, (e) repositioning only said primary register platen supporting said secondary platen bearing said object so that said image on said transparent register plate overlies a desired printing area on said object.

(f) removing said transparent register plate, (g) printing said object, (h) removing said secondary register platen and said attached printed object, and (i) repeating steps b, g, and h as many times as there are objects to be printed.

* * * * *